US007318397B2

(12) United States Patent
Ward

(10) Patent No.: US 7,318,397 B2
(45) Date of Patent: Jan. 15, 2008

(54) HIGH EFFICIENCY HIGH POWER INTERNAL COMBUSTION ENGINE OPERATING IN A HIGH COMPRESSION CONVERSION EXCHANGE CYCLE

(75) Inventor: Michael A. V. Ward, Arlington, MA (US)

(73) Assignee: Combustion Electromagnetics Inc., Arlington, MA (US)

( * ) Notice: Subject to any disclaimer, the term of this patent is extended or adjusted under 35 U.S.C. 154(b) by 133 days.

(21) Appl. No.: 11/139,745

(22) Filed: May 27, 2005

(65) Prior Publication Data

US 2006/0005793 A1 Jan. 12, 2006

Related U.S. Application Data

(63) Continuation of application No. 11/097,784, filed on Apr. 1, 2005, now abandoned.

(60) Provisional application No. 60/562,500, filed on Apr. 15, 2004, provisional application No. 60/558,911, filed on Apr. 2, 2004, provisional application No. 60/670,607, filed on Apr. 12, 2005, provisional application No. 60/575,011, filed on May 27, 2004.

(51) Int. Cl.

| | |
|---|---|
| ***F02D 75/04*** | (2006.01) |
| ***F02D 15/04*** | (2006.01) |
| ***F02B 75/32*** | (2006.01) |
| ***F02B 41/00*** | (2006.01) |

(52) U.S. Cl. ..... 123/48 R; 123/48 B; 123/197.1; 123/197.2; 123/197.3; 123/78 R; 123/78 B; 123/78 BA; 123/78 C; 123/78 E

(58) Field of Classification Search ..... 123/48 B, 123/48 C, 48 A, 48 AA, 48 R, 197.3, 197.2, 123/197.1, 197.4, 78 A, 78 B, 78 BA, 78 C, 123/78 E See application file for complete search history.

(56) References Cited

U.S. PATENT DOCUMENTS 1,627,719 A * 5/1927 Willis ..... 92/224

(Continued)

FOREIGN PATENT DOCUMENTS

GB 2318151 A * 4/1998
WO WO 03/089785 A2 * 10/2003

*Primary Examiner*—Stephen K. Cronin
*Assistant Examiner*—Ka Chun Leung
(74) *Attorney, Agent, or Firm*—Burns & Levinson LLP; Jerry Cohen

(57) ABSTRACT

A piston (10), a spring (15) operatively coupled to a piston, the spring being inside (21) or outside (41) the piston, and if the spring is inside the piston, the diameter of the spring is equal to 0.7 to 0.9, and if it is outside of the piston it is an external coil spring which is outside the cylinder which contains the piston and is able to provide a force of thousands of pounds per inch, and furthermore so that at light load the compression ratio (CR) is greater than 13 to 1 designated as CR0, at medium load has a compression ratio less then CR0 but greater than CReff, and at wide open throttle (WOT) has a CR equal to Creff, the CR is less than CR0 as would occur at medium or higher load which would lead to a flexing of the spring, and the cycle on the compression stroke is known as the HCX cycle where the pressure goes between Ppre and less than or equal to Pf.

23 Claims, 6 Drawing Sheets

U.S. PATENT DOCUMENTS 2,372,472 A * 3/1945 Campbell ..... 74/582
3,319,535 A * 5/1967 Holcombe ..... 92/208
3,667,433 A * 6/1972 Isley ..... 123/78 B
4,031,868 A * 6/1977 Karaba et al. ..... 123/78 B
4,241,205 A * 12/1980 Johnson ..... 549/396
4,510,895 A * 4/1985 Slee ..... 123/78 B
5,755,192 A * 5/1998 Brevick ..... 123/78 B
6,223,703 B1 * 5/2001 Galvin ..... 123/48 B
6,568,357 B1 * 5/2003 Rao et al. ..... 123/48 B
6,907,849 B2 * 6/2005 Galvin ..... 123/48 A
7,036,468 B2 * 5/2006 Kamiyama ..... 123/78 R
7,146,940 B2 * 12/2006 Knutsen ..... 123/48 B
7,165,528 B2 * 1/2007 Ward ..... 123/301
2004/0112311 A1 * 6/2004 Knutsen ..... 123/78 BA
2004/0211374 A1 * 10/2004 Kamiyama ..... 123/78 R
2005/0241612 A1 * 11/2005 Ward ..... 123/301
2006/0249103 A1 * 11/2006 Valdivia ..... 123/41.35

* cited by examiner

HIGH EFFICIENCY HIGH POWER INTERNAL COMBUSTION ENGINE OPERATING IN A HIGH COMPRESSION CONVERSION EXCHANGE CYCLE

This application claims priority under USC 119(e) of U.S. provisional application Ser. No. 60/575,011, filed May 27, 2004, and U.S. regular application Ser. No. 11/097,784 ('784) filed Apr. 1, 2005 now abandoned being a continuation thereof, and through the '784 application priority of U.S. provisional application Ser. No. 60/562,500, filed Apr. 15, 2004, and the U.S. provisional application Ser. No. 60/670/607, filed Apr. 12, 2005.

FIELD OF THE INVENTION

This invention relates to all spark ignition internal combustion (IC) engines for providing the maximum efficiency available in such engines based on the Otto cycle, by operating such engines at high compression ratios without the harmful effects of excessive high pressures, excessive friction, excessive heat transfer at compression and combustion, and other factors that limit the use of high compression ratio for high engine efficiency. The invention is especially useful for variable air-fuel ratio engines, such as special design spark ignition engines which can run very lean and fast burn at light loads for even higher efficiency, and run at stoichiometry in a homogeneous charge mode for high power without engine knock even when using regular gasoline fuel.

BACKGROUND OF THE INVENTION AND PRIOR ART

Attempts to increase the efficiency of the IC engine through ultra-lean, fast burn, high compression ratio, have had limited success, principally because of the inability to operate at the high compression ratios needed for highest efficiency. In the case of Diesel engines, high compression ratio (CR) of over 13 to 1 have generally not been successful in increasing efficiency because of the higher friction and heat transfer losses associated with the high CR. That is, above a certain compression ratio, high friction and high heat losses offsets any gains in efficiency due to the higher CR, as pointed out by Komatsu in an SAE paper on the spark ignited Diesel. However, in the case of gasoline engines, when high octane fuel was available, compression ratios of 15 to 1 were used with lean burn to achieve 40% to 50% better fuel economy, as shown by Michael May with his fast burn, lean burn Fireball Engine, reported in a 1979 SAE paper No. 790386. Also, the Ricardo Engineers, England, had some success with their High Ratio Compact Chamber (HRCC) engine operating at a higher CR on high octane fuel, reported in SAE paper No. 810017, 1981.

The main limitation of using high compression ratios with gasoline fuels is engine knock at high load due to the limited octane rating of most fuels. Even with the use of high octane rating fuels such as natural gas, use of high compression ratio has been of limited success, as found by Tecogen Inc., which makes natural gas based co-generation equipment using standard 2-valve gasoline engines converted to natural gas. High CR in the preferred range of 13 to 1 to 18 to 1 by necessity produces high engine cylinder pressures which stress the engine, and with engine knock, can damage the engine. But since an engine operates over a wide range of loads in a real world vehicle, it follows that under light load conditions, where the peak compression and combustion pressures are lower, high CR can be used.

Therefore, considerable work has been done with Variable Compression Ratio (VCR) systems to achieve a high CR at light loads and a low CR and high loads. Generally, they fall into two types: mechanical linkage type, of which there are many, and oil pressurized pistons. Of the mechanical linkage type, U.S. Pat. Nos. 4,517,931 and 6,412,453 are but a sampling. Of the oil-pressurized piston type, U.S. Pat. No. 4,241,705 is an example.

Another approach, which represents an indirect form of VCR, is to use a flexible material within, or connected to the piston, that gives way to limit the peak pressures, as exemplified by U.S. Pat. No. 6,568,357 B1, which uses elastomers, and by my PCT patent application PCT/US03/12058, referred to hence forth as '058, with International Publication No. WO 03/089785 A2 and date of 30 Oct. 2003, which uses preferably metallic springs either in the engine piston or connecting rod to both limit peak pressures at high load and allow for substantial pressures on compression at light loads so that strong air-squish is present to speed up the burn of ultra-lean mixtures. The importance of squish, especially in interacting with flow-coupling ignition sparks, is disclosed in my U.S. Pat. No. 6,267,107 B1, referred to hence forth as '107. The disclosures of my published patent application '058 and patent '107, and other patents, patent applications and published articles cited below, are incorporated herein by reference as though set out at length herein.

While these address but do not exhaust the possible ways of offering VCR systems for handling the issues of engine knock at high CR in gasoline engines, none of them address in detail the more fundamental problem of the Otto cycle for achieving best efficiency and power under all engine operating conditions, from light load where lean burn, fast burn is used at high compression ratio, to high load, where stoichiometric operation, with or without EGR is used, depending on the load requirements, to achieve an engine with highest efficiency, highest power, and low emissions.

Once the problem of lean burn (fast burn) has been solved, as has been done by my company, Combustion Electromagnetics Inc., CEI, as described in an SAE paper No. 2001-01-0548, the next step is to consider higher compression ratios. In our case, this is especially important in view of the fact that in the engine tests we conducted, we found that the lean burn capability of the engine tested (using homogeneous mixtures) was better at higher CR, where it was shown that at approximately 14 to 1 CR, the lean burn capability of the engine was well over the 30 to 1 air-fuel ratio (AFR) of the 11 to 1 CR, around 36 to 1 AFR and higher, depending on CR, also disclosed in my patent application '058. It is believed that this is in part due to the higher squish and turbulence at the higher CR, as well as to the higher adiabatic heating of the ultra lean mixture, to raise it to a relatively higher gas temperature prior to ignition to partly compensate the smaller amount of fuel. That is, the leaner mixture has a lower specific heat Cv at constant volume and a higher specific heat ratio $\gamma$, where $\gamma = Cp/Cv$, and where Cp is the specific heat at constant pressure.

SUMMARY AND OBJECTS OF THE PRESENT INVENTION

A new form of high efficiency, high power, low emissions engine based on the Otto cycle, but improving on it, designated "High Compression Conversion Exchange" cycle, or HCX cycle for short, is disclosed, which overcomes the fundamental problem of the Otto cycle. This application discloses in mathematical detail and physical preferred embodiments, simple and optimal ways to use the advantages and benefits of the new HCX cycle to achieve the highest engine efficiency at light loads, and high power at full load, in an otherwise conventional IC engine, preferably in a homogeneous charge spark ignition engine which provides the maximum power at high load and lowest tailpipe emissions through 3-way catalyst action, and best efficiency at light loads through lean burn, fast burn combustion.

The efficiency η of the Otto cycle at a CR designated also as "r", is given by:

$$\eta=1-1/r^{(\gamma-1)}$$

so that all other things being equal, the leaner the mixture (γ is highest), and the higher the compression ratio "r", then the higher the efficiency, where γ=Cp/Cv.

But the Otto cycle suffers from two fundamental problems. One is that the higher the CR, the higher the peak pressure in the engine cylinder, especially at high load, since the cycle requires heat addition at top center of the piston motion at constant volume. Using late burning, with close-to constant pressure, as in the Diesel cycle, or limited pressure, versus constant volume heat addition, compromises efficiency. For a homogenous charge engine this is not practical because of the difficulty of controlling hot spots in the combustion chamber which can cause engine knock by too early uncontrolled ignition.

The other fundamental problem of the Otto cycle engine is that the peak pressure occurs essentially at top center (TC) of the piston stroke, where the component of the force is radially inwards where no work can be done in rotating the engine crank by the high peak pressure Pi and total force Fi on the piston face, to also relieve the high peak pressure. Stated otherwise, the ability to use the high, maximum, available work is at its worst at TC. On the other hand, the ability to do work at 90° crank angle after TC is at a maximum, but the pressure in the cylinder (and the force exerted on the piston face) here is relatively lower.

It is therefore a principal object of the invention to overcome the above disclosed problems of the Otto cycle and provide an engine with a much higher efficiency through use of the HCX system/cycle, which takes the potentially high gas pressure energy at high engine loads associated with a high CR, occurring around TC, and converts it into another recoverable form deliverable later in the cycle. That is, above a certain defined "pre-load pressure" Ppre, heat addition occurs at close-to constant pressure instead of constant volume, by converting the potentially high excess pressure gas energy into another form of stored energy, preferably mechanical spring energy, so that the gas pressure peaks at a "set pressure" Pf, with associated set force Ff and temperature Tf, around TC, well short of the high peak pressures Pi, force Fi, and temperatures Ti of the Otto cycle. In effect, the HCX engine system is designed with a high compression ratio CR0, and takes the potential high pressure excess gas energy around TC at high loads associated with the pressure difference Pi−Pf and converts it to another form of stored energy to partially simulate an engine at a lower and safer CR at high loads but without the losses associated with the lower CR. The system is constructed and arranged to do this in a way that Pf is equal to a safe maximum pressure, approximately equal to that of the engine operating at wide-open-throttle (WOT) with close to 100% volumetric efficiency ($\eta_v$), at an effective compression ratio CReff of approximately 9 to 1 or other ratio that does not cause engine knock. The stored energy is recovered and released after the piston has moved to a point where the pressure P(x) starts to fall below Pf, wherein the stored energy is gradually released with minimum dissipation, in a way that it is converted to piston motion and useful work, where x represents the piston axial displacement from TC. The term "approximately" as used herein means within plus or minus 25% of the value it qualifies.

For the preferred embodiment where a steel spring is used to take up the excess force associated with the pressure difference Pi−Pf, the system operates by one or more spring means being further compressed from their pre-loaded compressed position (or elongated if under tension) around top center on the compression stroke due to the gas pressures in the combustion chamber exceeding the pre-load force Fpre, the spring being compressed in relationship to the excess pressure which drops with spring compression due to the gas expansion to attain an equilibrium position, storing the excess pressure as spring energy. The spring energy is then gradually released as the piston moves down and the pressure drops below Pf to the pre-load value Ppre, when the spring recovers to its pre-load position, having converted the potential excess pressure forces related to the high compression ratio occurring around TC, to a later point of crank angle rotation where the potential excess forces can do work in rotating the engine crank while having limited the peak pressures without the usual loss of cycle efficiency which accompanies limited pressure cycles.

The HCX system is further constructed and arranged such that the pressure Pcomp near the end of the compression stroke between 30° and 10° before TC, is approximately equal to the theoretical Otto cycle pressure, i.e. Pcom<Ppre, so that there is little, if any, drop in pressure due to the HCX system at that point, so that, in terms of my patent and patent applications '107 and '058, the high air squish flow is not compromised.

In the typical automotive vehicle case, the engine is designed for 13:1 to 24:1 CR, defined as CR0, with effective CR (CReff) of 8:1 to 11:1 at WOT, or possibly higher for higher octane fuels, but with CReff approximately equal to CR0 at typical driving light load conditions, such as ⅓ of load for a given engine speed. This requires pre-loading of the flexible material in a precise way for a given spring constant k to meet this requirement. The flexible material is preferably spring material, especially of the steel type which has very low loss and can absorb, release, and return over 95% of the energy stored in it.

The pre-loading of the flexible material with the pre-load force Fpre is preferably such as to insure no deflection except at around TC on the compression/combustion stroke. More precisely, in the cases where a pre-loaded spring is used in the moving parts of piston, connecting rod, or other, the spring is pre-loaded such that at the high speed limit of the engine, typically 6000 RPM, no spring deflection occurs from the centripetal force at bottom center (BC) of the engine motion at the engine's high speed limit.

Preferably, the spring is of the disk or wave compression type characterized by a high spring constant of thousands of pounds per inch, as required in the HCX system for a typical gasoline engine with piston diameters in the typical 2.5" to 4" diameter, operating at compression ratios above 10 to 1. Preferably, the spring is of the disk or wave type which is contained in the connecting rod under compression to supply a long length of spring with small deflection relative to the longest possible deflection for very long life time in the millions to tens of millions of cycles and higher, depending on application.

The design of the spring for a given "settle" or "set" force Ff, which is typically about 0.6 of Fi, is done as a mathematically arrived at best trade-off between Ff, the spring constant "k", which is preferably under 20,000 lb/inch, the total spring displacement (mostly pre-load xi), the compression ratios CR0 and CRset defined at WOT stoichiometric engine condition, and other parameters. Typically, this results in a pre-load force approximately ¾ of Ff, which for a typical car engine requires a pre-compressed length of about 2 times h0, where h0 is the clearance height for a flat piston and flat cylinder head at the high engine compression ratio CR0, and the term "about" means within plus or minus 50% of the value it qualifies.

The advantages of the HCX cycle in terms of its higher efficiency and low heat transfer under lean, fast-burn, light load conditions, leads to improved engine designs in any of a number of ways known to those versed in the art, such as using air-cooling instead of water cooling (with higher cylinder wall temperatures) given the lower peak pressures and temperatures, for even lower heat transfer and higher engine efficiency, while providing a simpler and lower cost engine power-plant with less vulnerability to failures. A preferred embodiment of the HCX cycle engine is with the squish-flow, 2-valve, dual ignition engine disclosed in my patent '107 and patent application '058, wherein the engine is designed on the basis of a high compression ratio of approximately 18 to 1 (CR0=18:1), where CRset is approximately 10:1, which improves the engine efficiency under all operating conditions, and particularly under ultra-lean, fast-burn conditions at light load, by providing high compression ratio and high squish flow at the spark plug sites for even leaner and faster burn operation.

An example of a preferred air-cooled HCX engine is one with a spring under tension surrounding the engine cylinder such that the cylinder can move upwards when the force exceeds the pre-load force Fpre. Another is an HCX engine system which uses a spring under compression, preferably disk type, surrounding an extension of the engine cylinder disposed in the engine crankcase, or its equivalent, such that the cylinder can move upwards when the pressure on compression and combustion exceed the pre-load force Fpre. These embodiments are more compatible with electrically actuated valves and 2-stroke engines which do not require a linked connection between the cylinder head and engine crank.

The HCX system allows for an improvement in ignition timing, in that the ignition timing can be set earlier, all other things being equal, since any excess in pressure prior to TC is stored in the spring and recoverable. In this way, a faster burn will occur with peak pressure closer to TC, with the excess energy associated with the pressure difference Pi−Pf stored just after top center.

In the HCX design, it is expected that the total flexible material deflection associated with the energy storage of the HCX system, is significantly greater than the displacement of the piston due to the crank rotation around TC at WOT.

Other features and objects of the invention will be apparent from the following detailed drawings of preferred embodiments of the invention taken in conjunction with the accompanying drawings, in which:

DISCLOSURE OF PREFERRED EMBODIMENTS

Figures 1A, 1B, 1C, 1D:
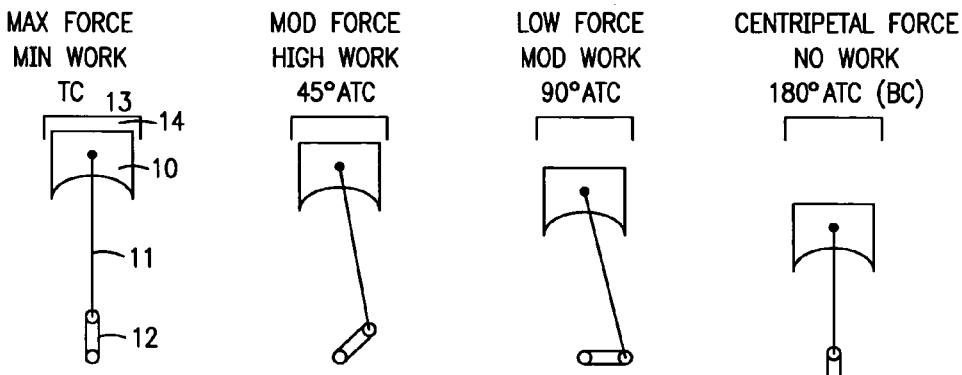
FIG. 1a (PRIOR ART) FIG. 1b (PRIOR ART) FIG. 1c (PRIOR ART) FIG. 1d (PRIOR ART)
FIGS. 1*a* to 1*d* represent, in partial schematic side-view form, piston locations at four different crank angle positions.

FIGS. 1*a* to 1*d* represent, in partial schematic side-view form, piston locations at four different crank angle positions, at TC, at 45° after TC, at 90° after TC, and at 180° after TC. In the drawings, the piston 10 is connected via connecting rod 11 to the crank radius element 12, which work to move the piston through compression, combustion and expansion, and exhaust from the combustion chamber 14 defined between the cylinder head 13 and the piston 10. The engine can be a 2-stroke or 4-stroke engine, a spark ignition or diesel engine, but preferably, and for the purposes of this disclosure, is assumed to be a 4-stroke spark ignition homogeneous charge engine, which more ideally and advantageously can be minimally cooled using air-cooling as a result of the lower heat available from this higher engine efficiency, which preferably operates as a lean burn engine at light loads where most of the driving is done.

FIG. 1*a* represents one of the fundamental problems of the Otto cycle engine, namely that the combustion gas pressure force is maximum while its ability to do work in rotating the crank is minimum, given the force is vertically downwards (radially inwards). FIG. 1*b* represents a best compromised location where the force is moderately high and the moment of force about the crank is moderately high for high work to be produced. FIG. 1*c* represents the case where the ability to do work is maximum but the force is low and the work is moderate. And FIG. 1*d* represent the piston at bottom center (BC) which is a special case which the HCX system must deal with successfully.

Figure 7:
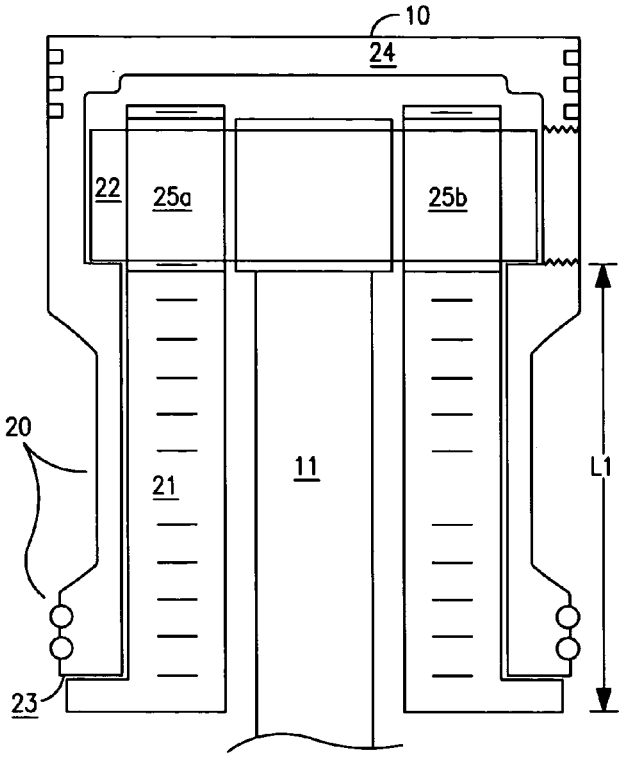
FIG. 7 is a side-view drawing of a piston with an elongated skirt with a flexible material under tension contained between the wrist pin and the bottom end of the piston wherein the temperature is lower than above the wrist pin and more length is available for the flexible material to provide longer life, which allows small relative motion of the piston top relative to the wrist pin when the force on the piston face exceeds the pre-load force Fpre which the spring material is under.
Figure 8:
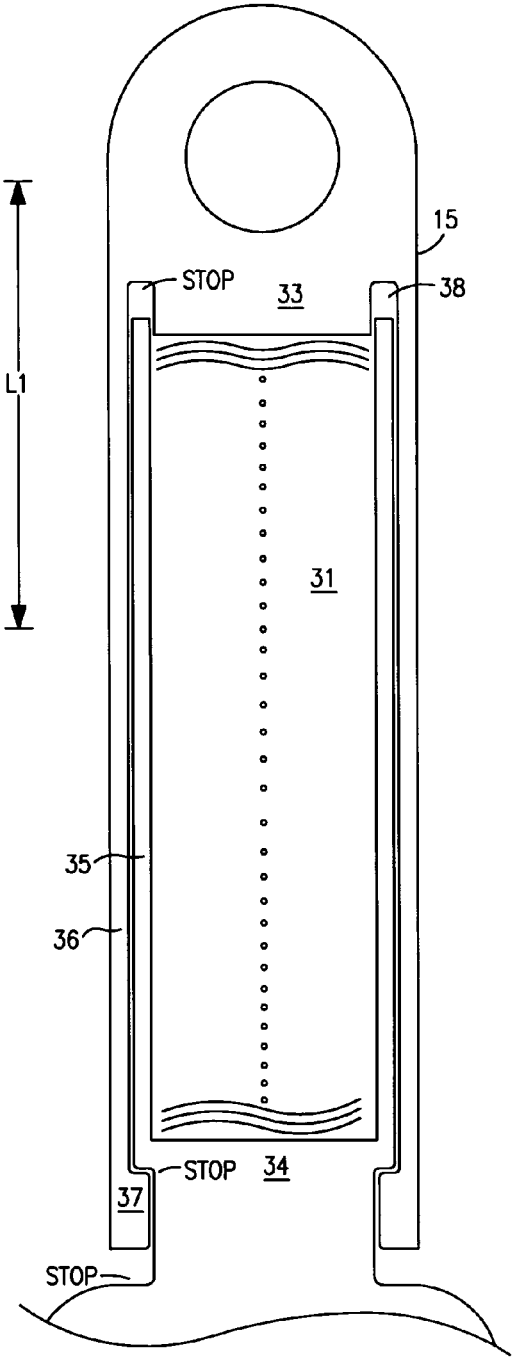
FIG. 8 is a partial side view drawing of a preferred HCX system comprising a spring loaded engine connecting rod for storing the extra combustion energy at high load around TC.
Figure 8A:
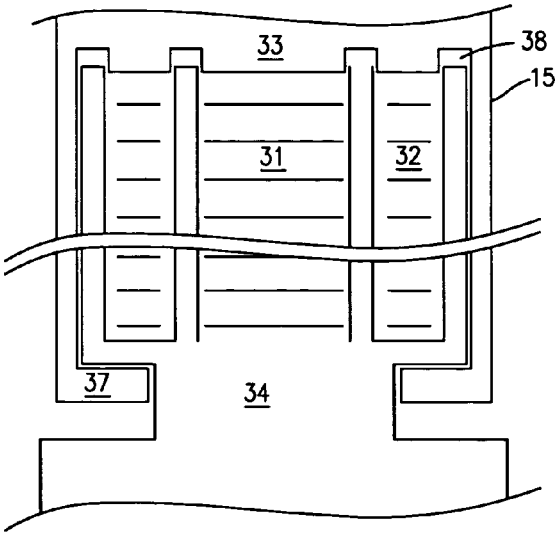
FIG. 8*a* is another form of the connecting rod of FIG. 8 with two coaxial springs to increase the life of the spring and provide greater flexibility of design. These designs are made to accommodate disk or wave type stacked springs, which work only under compression, to provide the high spring constant k of thousands of pounds per inch.

In particular, at BC, there is required a centripetal force on the piston to reverse its downwards motion which will appear as tension of the spring of FIG. 7, and compression of the springs in the connecting rod as in FIGS. 8 and 8*a*. To prevent motion of the piston, the springs must be pre-loaded to a force greater than the centripetal force Fcent derived below.

For our model, we assume the case of FIG. 8 where a mass weight M of 2 pounds is assumed for the piston and movable outer portion of the connecting rod, and define the engine speed limit Nf as 6,000 RPM. We assume a stroke length S of 3.5" as representative of a typical larger vehicle (and hence larger force Fcent). The force Fcent is given by:

$$\begin{aligned} Fcent &= M*(S/2)*(2*\pi*Nf)^2 \\ &= (2/32)*(1.75/12)*(200*\pi)^2 \\ &= 3{,}600 \text{ pounds (lb)} \end{aligned}$$

Hence, in the preferred design of such an engine, with an assumed bore diameter of 3.6" with displacement of 140 cubic inches in a 4-cylinder format, a pre-load force equal to and greater than 3,600 lb is preferred, understanding that in normal driving the engine RPM rarely exceeds 5,000 RPM. And if there is an occasional spring deflection at bottom center, it would be small and rare, and not effect the overall life of the spring.

Figure 2A:
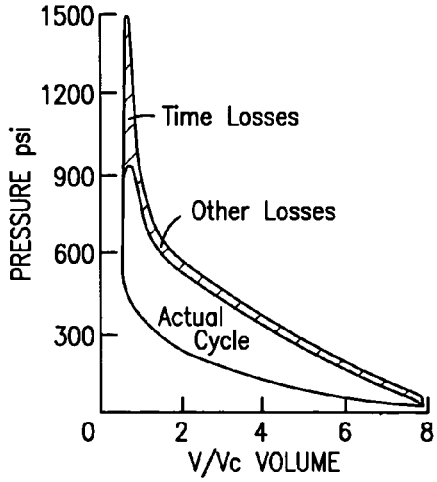
FIG. 2a (PRIOR ART)
FIG. 2*a* represents a Pressure-Volume (P-V) diagram of a conventional gasoline cycle against the more ideal Otto cycle at a high CR.

FIG. 2*a* represents a Pressure-Volume (P-V) diagram of a conventional gasoline cycle at 90% of WOT, shown with a high peak combustion pressure of approximately 900 psi (pounds per square inch), against the more ideal Otto cycle with a theoretical peak pressure of 1,500 psi for a CR of 15:1, as per the book "The Internal Combustion Engine in Theory and Practice", by Charles Fayette Taylor, MIT Press, 1965. The reduced peak pressure to 900 psi assumed for the actual engine is due to "time losses", i.e. completion of combustion well after TC, typically 30° ATC, especially as would be required at high CR. The area enclosed by the smaller closed curve, designated "Actual Cycle", represents significantly less work done than the larger, more peaked theoretical Otto cycle. The difference in area below the 900 psi level, indicated as "Other Losses", represents mainly heat transfer losses from the high temperature gas to the surrounding wall and cooling system, and frictional losses. The horizontal axis represents the cylinder volume V divided by the volume Vc at top center.

Figure 2B:
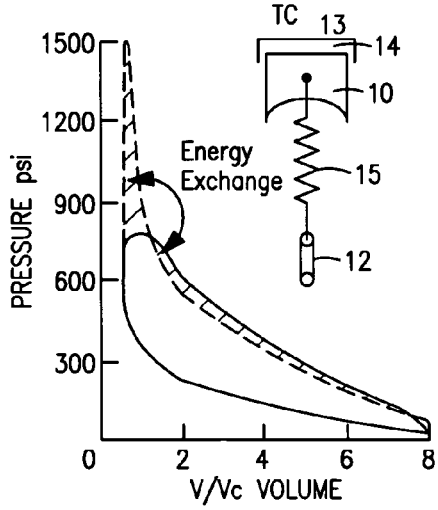
FIG. 2*b* represents a P-V diagram of the HCX cycle for an otherwise conventional gasoline engine against the more ideal Otto cycle at a high CR. Both are at WOT.

FIG. 2*b* represents a P-V diagram of the HCX cycle (solid curve) for an otherwise conventional engine against the more ideal Otto cycle (broken curve) at the same high compression ratio of FIG. 2*a*. Both curves represent the engine at WOT. In the case of FIG. 2*b*, the HCX feature is indicated by the schematic similar to FIG. 1*a* alongside the two P-V curves, except that the connecting rod 15 is assumed to be flexible, preferably made up of compressible spring as per FIG. 8. Like numerals represent like parts with respect to the earlier figures. By being able to store the excess high pressure energy above the HCX cycle maximum of Pf (750 psi shown in the drawing) in the spring, then that energy is released and mostly recovered as the larger area below the HCX peak Pf, to capture most of the Otto cycle work available at the very high compression ratio. In effect, as indicated, the high peak energy is exchanged in the form of lower pressure energy between the dashed curve (Otto cycle) and the wider HCX curve.

Figure 3A:
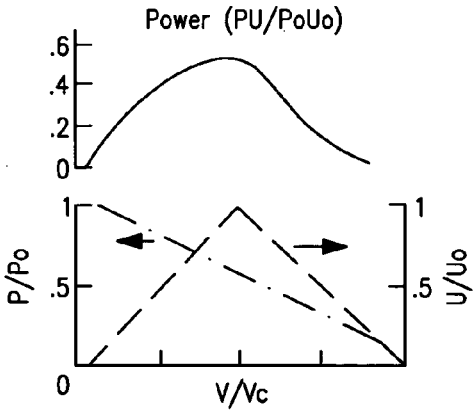
FIG. 3a (PRIOR ART)
FIGS. 3*a* and 3*b* are graphs of simplified piston pressure and velocity relationships during the expansion stroke, as well as the Power produced by the piston from the burnt gasses, for the conventional Otto cycle of FIG. 2*a* and the HCX cycle of FIG. 2*b*.
Figure 3B:
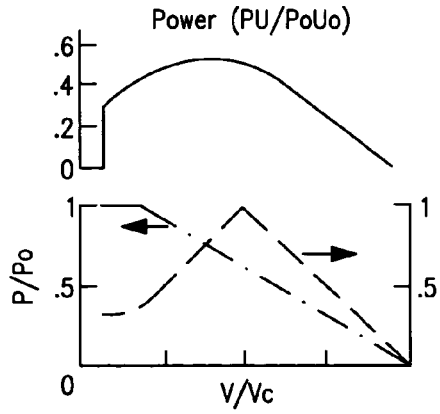

This is indicated by FIGS. 3*a* and 3*b*, which are graphs of simplified piston pressure and velocity relationships during the expansion stroke, as well as the Power produced by the piston from the burnt gasses, for the conventional Otto cycle of FIG. 2*a* (FIG. 3*a*) and the HCX cycle of FIG. 2*b* (FIG. 3*b*). The point to note here is that in the HCX cycle of FIG. 3*b*, work is done, and power is produced, at the low V/Vc, i.e. around TC, versus no work done in the normal cycle, i.e. the Power curve begins at zero, instead at a high threshold value indicated in FIG. 3*b* due to the compression FIG. 4*a* indicates a P-V diagram of a more conventional, lower compression ratio cycle, with two curves, the actual cycle (solid curve) against the more ideal Otto cycle (dashed curve). FIG. 4*b* indicates a P-V diagram of the HCX cycle for the otherwise same engine of FIG. 4*a*, indicating the actual HCX cycle (solid curve) with peak indicated set pressure Pf of 750 psi, against the more ideal Otto cycle (broken curve). Both are assumed at WOT.

Figure 4A:
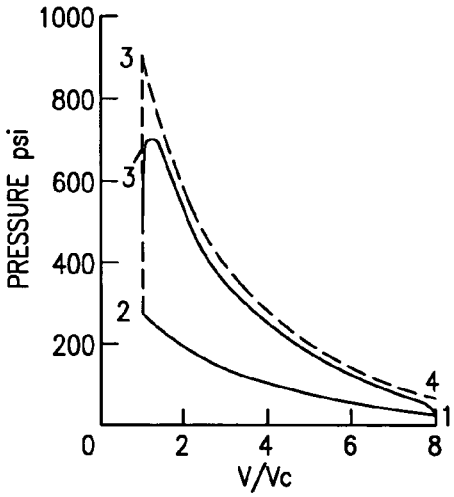
FIG. 4a (PRIOR ART)
FIG. 4*a* is a P-V diagram of a conventional engine cycle against the more ideal Otto cycle at a typical CR.
Figure 4B:
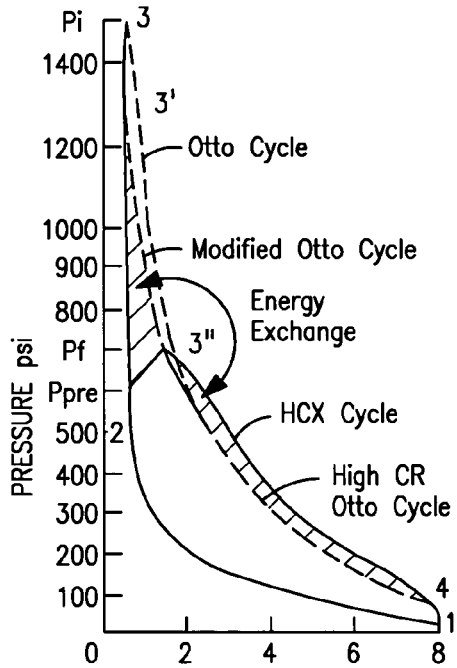
FIG. 4*b* is a P-V diagram of the HCX cycle for an otherwise conventional gasoline engine against the more ideal Otto cycle at a high CR. Both are at WOT.

Visual inspection of the two figures shows the higher work done (areas enclosed by the solid curves) of the HCX cycle (FIG. 4*b*) than done by the conventional cycle (FIG. 4*a*). And as with FIG. 2*b*, we have some of the energy in the modified Otto cycle (discussed later relative to the ideal Otto cycle) above the value Pf (750 psi indicated) delivered to the value below Pf, which shows up as a broader curve, i.e. the high peaked Otto cycle and modified Otto cycle energy (work done) above Pf is converted to lower pressure, more practical energy (work done). The numerals on the curves are as in Taylor's book, 1 representing the initial condition, 2 is the end of the compression stroke, 3, 3', and 3" the peak combustion pressure of the ideal and modified Otto cycle and HCX cycle, and 4 is the end of the exhaust stroke.

Figure 5A:
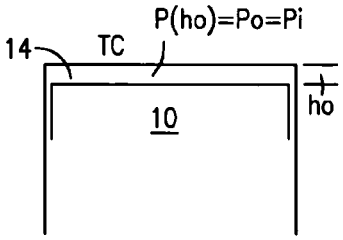
FIGS. 5*a*, 5*b* and 5*c* represent schematic side views of the piston at and just beyond the top center position defining the clearance and pressure parameters of the HCX cycle.
Figure 5B:
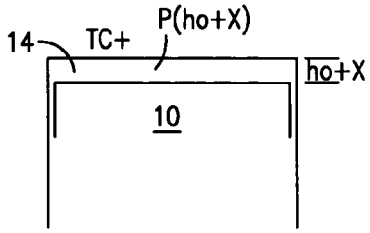
Figure 5C:
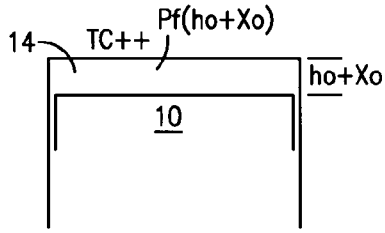

With these drawings, and the schematic side view drawings of FIGS. 5*a*, 5*b* and 5*c*, which indicate the piston at, and just beyond, the top center position defining the clearance and pressure parameters of the HCX cycle, an analysis of the HCX cycled is disclosed next, which brings out, in detailed mathematical equation and other form, the various features and relationships that comprise the HCX cycle.

Initially following nomenclature from Taylor's book, a basic idea is to design an engine with a high compression ratio, say 15 to 1 as an example, so that the peak Otto cycle pressure at the end of combustion at WOT and stoichiometric AFR, designated as P3 (15:1, λ=1) or as Pi, is reduced to a safe knock-free value of 8:1 to 11:1 for gasoline, which is designated as P3 (8:1, λ=1) or as Pf for an assumed 8:1 CR, known as CReff or CRset, where λ is the AFR divided by the stoichiometric AFR. From Taylor's book, assuming a volumetric efficiency ηv of 90% at WOT, and assuming the initial pressure P1 is atmospheric (14 psi);

$$Pi=120*P1*\eta v=1{,}500 \text{ psi}$$

$$Pf=60*P1*\eta v=750 \text{ psi}$$

where Pi and Pf are fixed, and more generally Pi is a function of AFR and load (ηv).

For simplicity, we assume an automotive type engine with a 3.6" bore which has a cross-sectional area of 10 square inches, so that cylinder pressure P(x) in psi can be translated to force F(x) in pounds by simply multiplying by 10, understanding that smaller engines will have lower multiplicative factors, and vice vera, which translates to smaller springs for smaller engines, and vice versa.

For the present example:

$$Fi=15{,}000 \text{ lb}$$

$$Ff=7{,}500 \text{ lb}$$

If one assumes a stroke "S" of 3.5", then for the base compression ratio CR0 of 15 to 1 in the present example, one can calculate the clearance height ho as per FIG. 5*a* as:

$$ho=S/(CR0-1)=3.5/(14)=0.25''$$

I now define a force on the piston face for a displacement "x" of piston motion as F(x). The question then is how will the force F(x) change from an initial value F(0) as the piston moves relative to the cylinder head a distance "x". I derived a particular simple form of an expression assuming adiabatic expansion with a constant "γ" equal to 1.32 at a temperature of approximately 2,000° F., namely:

$$F(x)=F(0)*ho^{\gamma}/(ho+x)^{\gamma}=F(0)*ho/(ho+1.5*x)$$

which is accurate to within 2% in the range of x values of interest.

Defining xo as the displacement that reduces the WOT force F(0) or Fi to Ff (which is also designated as F(xo)), it follows that for:

$$F(0) = 15{,}000 \text{ lb, and for } F(xo) = 7{,}500 \text{ lb, that:}$$

$$xo = [ho/1.5]*[Fi/Ff-1]$$

$$= ho/1.5$$

$$= 0.167'' \text{ in this case.}$$

The force Fs(x) on a spring whose displacement is x, assuming a spring with a linear spring constant k, which has a pre-load displacement "xi", is given by:

$$Fs(x)=k*(xi+x)$$

It follows that the spring must be defined such that:

$$Ff=Fs(xo)=k*(xi+xo), \text{ and}$$

$$Fpre=Fs(0)=k*xi$$

$$k=[Ff-Fpre]/xo$$

$$xi=Fpre*xo/[Ff-Fpre]$$

from which we can determine k and xi once Fi, Ff, Fpre and xo are specified.

Ff has already been specified, and xo has been determined from Fi, so what remains is for Fpre to be specified. Clearly, Fpre must be less than Ff, but as close to Ff as is practical. As a practical matter, there are problems with specifying Fpre to be, say, within 10% of Ff, and a more practical value may be closer to 20% of Ff. Taking Fpre as 0.8 of Ff, i.e. 6,000 lb.

$$k=[7{,}500-6{,}000]*3/[2*ho]=4{,}500/0.50=9{,}000 \text{ lb/inch}$$

$$xi=6{,}000*xo/1{,}500=4*xo=0.66''$$

and the total spring displacement, defined as x1, is given by:

$$x1=xi+xo=4*xo+xo=5*xo=0.833''$$

which is on the large size for a practical, long life spring.

Figure 6A:
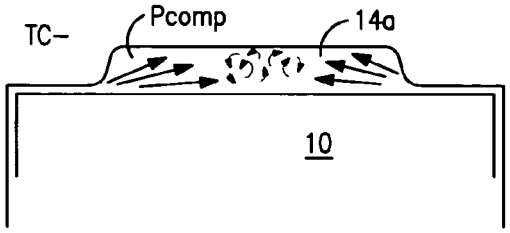
FIGS. 6*a* and 6*b* represent schematic side views of the preferred squish flow type of combustion chamber with the piston just before TC where squish is maximum, and after at a point where the cylinder pressure P(ho+xo) equals the set pressure Pf wherein the outwards flow velocity and heat transfer from the flowing gases to the cylinder head and piston are significantly reduced due to the motion of the piston.

This satisfies four key conditions. One is to limit "k" to, say, under 20,000 lb/inch. A second is that to limit the pre-load spring displacement, to say, no more than a few times xo. The third is to require that the pre-load force Fpre be greater than the centripetal force Fcent, which in this example was 3,600 lb, which is easily satisfied. And fourth, is to require that Fpre be approximately equal to or greater than the compression force F2 which produces the high squish (see FIG. 6*a*) under lean burn conditions. Following Taylor, and assuming λ=2, CR0=15:1 in this case, and assuming ηv=100% which represents ½ load, it follows:

$$P2=36*14=500 \text{ psi}$$

$$F2=5{,}000 \text{ lb}$$

which is less than the pre-load force in this example, as required. This means that for up to 50% load driving condition with a maximum AFR of 30 to 1 for gasoline, one has the full effect of the squish flow, i.e. piston at the end of compression stroke at TC corresponds to the base compression ratio CR0 of 15 to 1.

Up to this point, a factor which determines xo has been ignored, namely that in the operation of the HCX cycle, the peak pressure Pi used to evaluate P(x) is less than that which would be attained in the Otto cycle (see FIG. 4*b*). As the air-fuel mixture is combusted, the pressure rises at constant volume until it reaches the pre-load value Ppre, where after it rises at closer to constant pressure instead of constant volume, to a potential peak pressure Pi' (point 3' of FIG. 4*b*) less than Pi (point 3), since the specific heat at constant pressure Cp is greater than Cv. The peak pressure Pi' is related to Pi by:

$$Pi'=Pi-[Pi-Ppre]*(\gamma-1)/\gamma$$

Hence, the calculation of xo must be corrected accordingly, designated as xo'. Assuming "γ" equals 1.28 at the high temperatures where combustion is completed, for the above example, one obtains (remembering Fi and Fpre are equal to ten times the pressure terms):

$$\begin{aligned} Ff' &= 15{,}000-[15{,}000-6{,}000]*.28/1.28 \\ &\approx 13{,}000 \text{ lb} \\ xo' &= [ho/1.5]*[(13{,}000/7{,}500)-1] \\ &\approx 0.5*ho \\ &= 0.125'' \\ x1' &= 5*xo' \\ &= 0.625'' \end{aligned}$$

which is a more acceptable displacement for the spring.

The spring constant accordingly changes:

$$k'=k*xo/xo'\approx 9{,}000*4/3=12{,}000 \text{ lb/inch}$$

From the above, one can calculate the work stored in the spring from the excess pressure compressing the spring, defined as Ws.

$$\begin{aligned} Ws &= \int k*(xi+x)\,dx \quad \text{with the limits from } 0 \text{ to } xo' \\ &= \int [Fpre+k*x)\,dx \\ Ws &= \frac{1}{2}*[Fpre+Ff]*xo' \end{aligned}$$

Substituting from the above values, we obtain:

$$Ws=\tfrac{1}{2}*[6{,}000+7{,}500]*0.125''/12$$

$$Ws=70 \text{ ft lb}$$

I derived a simple expression for the energy W(x) that would be released and delivered to the piston in the ideal Otto cycle as the gas expands from TC to any point x, as long as x is less than 2*ho (although an expression for any value of x has also been derived):

$$W(xo)=xo*Fi*\ln[1+1.5*xo/ho]=xo*Fi*\ln 2$$

Substituting Fi=15,000, xo=ho/1.5

$$W(xo)=145 \text{ ft lb}$$

Therefore, of the total available excess energy, approximately ½ is transferred to the spring to be delivered as piston motion at WOT. This means that an engine using HCX with a compression ratio CR0 of 15:1 and a peak settling pressure corresponding to a CR of 8:1, called CRset, will have a higher output power than an equivalent engine operating at the set compression ratio CRset (8 to 1 in this example). Furthermore, the effective expansion ratio EReff of the HCX engine at WOT is given by:

$$EReff=[S/[(ho+xo')]]+1=3.5/0.375+1=10.3 \text{ to } 1$$

in this particular example, which is higher than CRset, which is beneficial.

It should be noted that a more exact analysis should include the centripetal force Fcent at top center (TC) which increases the pre-load force according to the engine speed, i.e. if we define Fcent at its maximum value at its maximum RPM(0) as Fcent(0), then at an arbitrary RPM, $$Fcent=Fcent(0)*[\text{RPM}/\text{RPM}(0)]^2$$

so that in this case, for a typical engine RPM of 2,400 RPM $$\begin{aligned} Fcent &= 3{,}600*[2{,}400/6{,}000]^2 \\ &= 3{,}600*0.16 \\ &= 576 \text{ lb} \end{aligned}$$

or under 10% of the pre-load force of 6,000 lb, which is a small correction. which will have a negligible effect on the design for non-high speed performance engines.

However, to take this factor into account modifies the basic equation, from which the pre-load is defined, as follows:

$$Fs(x)=k*(xi+x)+Fcent$$

which, following the above analysis, results in the more complete equation:

$$F(x2)=Fi*[1/(1+1.5*x2/ho]=k*[xi+x2]+Fcent$$

where F(x2) represents the force when the pressure forces and spring forces are in balance.

At this point one has enough information to consider a factor relating to the design integrity of the system. This has to do with the resonant frequency of oscillation "fo" of the spring system. Assuming for simplicity a mass of one pound and a spring constant k of 10,000 lb/inch, we obtain for the resonant frequency:

$$\begin{aligned} fo &= [1/(2\pi)]*[k/m]^{1/2} \\ &= [1/(2\pi)]*[10{,}000*12*32/1]^{1/2} \\ &\approx 300 \text{ Hz} \\ fo &= 18{,}000 \text{ cycles per minute,} \end{aligned}$$

which is three times the typical top engine speed of 6,000 RPM, and therefore of no concern in the engine operating range in terms of runaway oscillations of the spring system.

Figure 9:
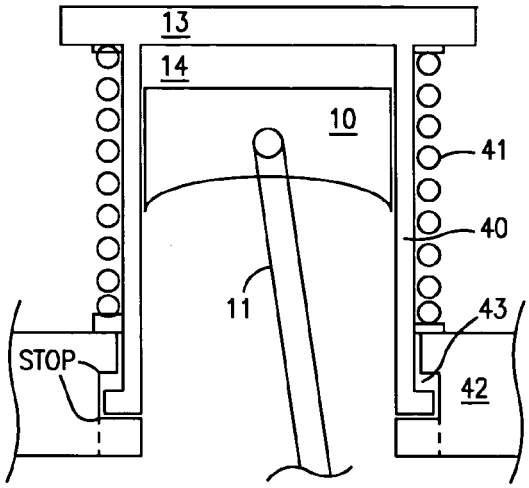
FIG. 9 is a partially schematic side-view drawing of an HCX system comprised of a free standing engine cylinder as could be found in an air-cooled engine with a coil spring able to provide force of thousands of pounds per inch under tension outside the cylinder to allow for small vertically upward movement of the cylinder and cylinder head relative to the piston when the pressure force in the combustion chamber exceeds the pre-load force Fpre.
Figure 10:
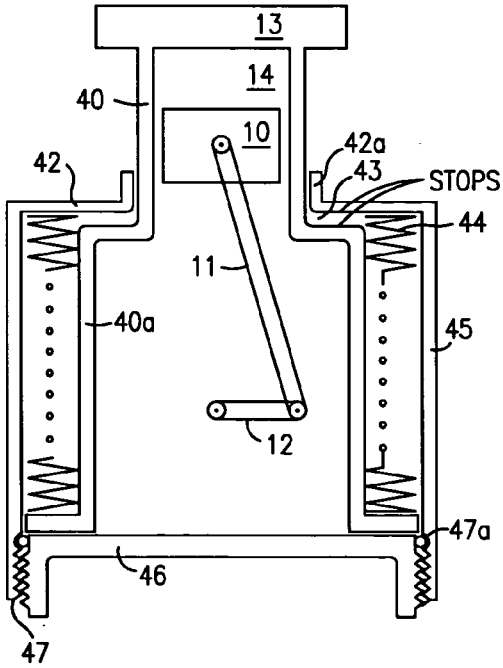
FIG. 10 is a version of HCX system of FIG. 9 except that a spring is located in the crank case outside of an elongated larger diameter extension of the engine cylinder and is under compression instead of tension to allow for the use of long, large diameter disk type spring means of high spring constant k of thousands of pounds per inch to allow for small vertically upward movement of the cylinder and cylinder head relative to the piston when the pressure force in the combustion chamber exceeds the pre-load pressure Ppre.

For the systems of FIGS. 9 and 10, where the mass is one to two orders greater, the system resonant frequency could be a problem. But in these cases, the spring constant could be made somewhat greater to partially offset the higher mass. For example, if the mass is 27 lb, we can design the spring with a high spring constant of, say, 30,000 lb/inch, so that the resonant frequency would correspond to 6,000

RPM, which can be set to be above the maximum engine operation of, say, 5,000 RPM. In addition, the chances of knock induced resonant oscillation are lower at high engine RPM. In addition, the high spring constant is associated with a high spring pre-load force Fpre and small displacement xi, so that for an engine operating at wide load condition from very light to WOT, as in a car engine, the occasions where the spring would experience displacement would be rare, i.e. at high loads where an engine may only spend a few percent or less of its time.

There are two pertinent points to emphasize. One is that at high power engine operation the HCX cycle at the high base compression ratio CR0 produces more power than the standard Otto cycle at the lower compression ratio. This implies that for the same maximum power achieved at stoichiometric operation and WOT, one can use significantly higher EGR for the HCX cycle engine for significantly lower NOx emissions than the standard engine, as well as achieving the much higher efficiency at light loads.

The other pertinent point is that even without a detailed rigorous cycle analysis one can conclude that at light loads where the peak pressure Pi is much lower, the effective compression ratio CReff is higher than CRset, and at very light loads where the peak pressure is equal to the pre-load pressure, Pi=Ppre, the effective compression is equal to the base compression ratio CR0 to maximize the light load efficiency.

Using Taylor's book, the peak pressure Pi at $\lambda=2$ and CR=15:1 and maximum volumetric efficiency ($\eta v=1.0$) is equal to 90*14=1,260 which represents half engine load.

It follows that at an engine load of:

$$\text{Load}=0.5*(Ppre/Pi)=0.5*(6000/1260)\approx 1/4 \text{ of full load}$$

the effective compression ratio is the base compression ratio CR0 of 15:1.

Comparing the efficiency $\eta$ for stoichiometric operation at the set CR of 8:1, and ultra lean operation with $\lambda=2$ and CR=15:1, then from Taylor's book:

$$(8:1,\lambda=1)=43\%$$

$$\eta(15:1,\lambda=2)=57\%$$

which represents a 33% increase in efficiency ignoring the lower pumping losses and lower heat transfer losses, which can increase the efficiency gain to approximately 50%.

To calculate the effective compression ratio CReff at higher values of light load, e.g. above ¼ load in this example, requires we solve the equation for x1, where x1 represents the spring displacement (less than xo) for a given peak pressure Pi and corresponding force Fi for a given engine operating condition.

$$Fi=k*[xi+x1]*[1+1.5*x1/ho]$$

Substituting xo for 2*ho/3, the equation can be re-written to make x1 the subject:

$$[x1+xi]*[x1+xo]=[Fi/(k*xo)]*xo^2$$

which is a quadratic equation which can be solved for x1. Using the example of neglecting the lower peak pressure Pi', with xi=4*xo and k=9,000 lb/inch, $$[x1+4*xo]*[x1+xo]=[Fi/(k*xo)]*xo^2$$

$$[x1+2.5*xo]^2=[Fi/(k*xo)+2.25]*xo^2$$

$$x1=\{[Fi/(k*xo)+2.25]^{1/2}-(2.5)\}*xo$$

As a check, on can substitute Fi=15,000 lb, and k*xo=1, 500 lb $$x1=[(12.25)^{1/2}-2.5]*xo=[3.5-2.5]*xo=xo \text{ as expected.}$$

A higher pre-load force Fpre extends the light load range to higher values where one achieves the light load high efficiency. But this also increases the settling pressure Pf and Force Ff. Therefore, an object of this invention is to use as high a settling force without causing engine knock. High octane fuels such as natural gas and ethanol have an advantage here, as well as engine designs which increase the tolerance for higher compression ratios, especially at low speeds where knock is worse. Such engine designs can include cylinder head design and variable valve timing. In my patent '107 I disclose placing the combustion chamber in the cylinder head, mostly under the exhaust valve, which can increase WOT compression ratio from 9:1 to 11:1, to extend the range of maximum efficiency at light loads by allowing for a higher pre-load force Fpre.

For example, a pre-load pressure Ppre which is approximately ½ of the peak Pi, and a set pressure Pf approximately 0.6 of Pi, is a good design trade-off. With reference to the above example, it would provide the full high Otto cycle efficiency for up to 30% of full load for an air-fuel ratio of 30:1 AFR. Between 30% and 50% of full load, the effective compression ratio CReff would decrease progressively from CR0 to above CRset.

One problem with the design is that as the value of the pre-load force Fpre approaches the value of the set force Ff, the spring constant must accordingly decrease for a given displacement xo or xo'. But to maintain the slightly higher pre-load force Fpre, the pre-load displacement xi must increase. For example, increasing the pre-load force from 6,000 lb to 6,750 lb for a set force Ff of 7,500, i.e. reducing the difference Ff−Fpre by ½ will slightly more than double the pre-load displacement xi (or xi'), granted the spring constant k is halved. But this is a more difficult condition for the spring design.

Therefore, an important object of the present invention is to offer a spring and other related, or combination of, mechanical systems such that a high pre-load force Fpre close to the set force Ff is attained, and once the pre-load force level is met in the engine operation, to have a relatively lower spring constant become active so that the set force Ff is not exceeded. As it turns out, disk springs offer this feature, i.e. drop in k with force and deflection, so that with proper design, the slope change of k(x) versus x can be made to take place at essentially xi'.

FIG. 7 is a side-view drawing of a piston 10 with an elongated skirt 20 with a flexible material 21 under tension contained between the wrist pin 22 and the bottom end of the piston 23, wherein the temperature is lower than above the wrist pin, and more length L1 is available for the flexible material to provide longer life of the flexible material, which allows small relative motion of the piston top 24 relative to the wrist pin 22 when the force on the piston face exceeds the pre-load force Fpre which the flexible material is under. The flexible material can be of any type, preferably of an efficient type with high spring constant k in the order of magnitude of 1000 s lb/inch for a typical car engine piston, and proportionally lower and higher depending on the peak piston forces which are proportional to the set pressure Pf and the piston area A. In general, the smaller the piston, the smaller k, and vice versa.

In the figure, the spring 21 is cylindrical, with its outer diameter (OD) close to the inner diameter (ID) of the piston 10, and its ID of small diameter for maximum use of the available volume, but providing enough clearance for the connecting rod 11. As shown in the figure, the spring 21 is attached to the wrist pin 22 via two rings 25*a* and 25*b*, intimately attached to the flexible material 21, and molded if the elastic material is a solid, high temperature elastomer.

FIG. 8 is a partial side view drawing of a preferred HCX system comprising a spring loaded engine connecting rod 15 with cylindrical spring 31 for storing the extra combustion energy around TC. FIG. 8*a* is another partial side view of a form of the connecting rod 15 of FIG. 8 with two coaxial springs 31 and 32, instead of one, to increase the life of the spring and provide greater flexibility of design. These designs are made to accommodate stacked disk springs 31, 32, which work under compression to provide the high spring constant k of thousands of pounds/inch for passenger vehicles, with the desired non-linear k.

The spring 31 in FIG. 8 is compressed and held between the top part 33 of the connecting rod 15 and a bottom part which comprises a tubular section 35 inside of which is the spring and which slides within an outer tubular section 36 which is part of the top part 33 of the connecting rod and has a bottom section 37 which acts as a "STOP" for the inner section 34 to allow for pre-compressing (pre-loading) of the spring. The top section 33 has a small channel 38 of length that is equal to the maximum permissible compression of the spring, i.e. approximately equal to xo, which also act as a "STOP" for the maximum spring compression. The bottom "STOP" section is only a partial cylinder to allow for assembly of the two-part spring loaded connecting rod by compression and twisting to lock the parts together. Operation and assembly of the two spring loaded connecting rod 15 of FIG. 8*a* is similar to that of FIG. 8, with like numerals representing like parts with respect to FIG. 8. This provides an, in-effect, a longer spring for longer life for a given spring displacement.

FIG. 9 is a partially schematic side-view drawing of an HCX system comprised of a free standing engine cylinder 40 as could be found in an air-cooled engine with an external coil spring 41 able to provide force of thousands of pounds per inch under tension which is located outside the cylinder 40 to allow for small vertically upward movement of the cylinder and cylinder head 13 relative to the piston 10 when the pressure force in the combustion chamber exceeds the pre-load force Fpre. Like numerals representing like parts with respect to the earlier figures.

The cylinder slides inside of a top section 42 of the crankcase, within a slot 43 which provides "STOPS" at two ends to constrain the upward and downward motion of the cylinder to a maximum movement approximately equal to xo'. The slide and constraint means 43 is one of many possible designs for guiding and limiting the travel of the cylinder. In this engine design, the cylinder and head are relatively light weight to accommodate a resonant frequency fo above the operating RPM of the engine. This design is especially useful in applications such as 2-stroke engines where the valves are ported in the cylinder.

FIG. 10 is a version of HCX system of FIG. 9 except that a spring 44 is located in the crank-case 45 outside of an elongated larger diameter extension 40*a* of the engine cylinder 40 and is under compression instead of tension to allow for the use of long, large diameter disk type spring means of high spring constant k of thousands of pounds per inch to allow for small vertically upward movement of the cylinder and cylinder head relative to the piston, when the pressure force in the combustion chamber exceeds the pre-load force Fpre. Preferably, the pre-load force Fpre is close to the set force Ff, which can be done given the non-linearity of disk springs. Ff is as close to the peak potential force Fi at WOT to limit movement of the cylinder to close to WOT, to both extend the life of the spring and other engine parts. Like numerals represent like parts with respect to the earlier figures.

Shown in the figure is a crankcase base plate 46 which is shown with an engaging thread 47 connecting it to the sidewall of the crankcase 45, with an O-ring oil-seal 47*a*. By tightening the base plate 46 the spring 44 is pre-loaded to the desired setting. It also allows for easy adjustment of the pre-load force Fpre without having to disassemble the engine. Note that the cylinder 40 is guided by upper crankcase cylindrical extension 42*a* below which are natural "STOPS".

Figure 11:
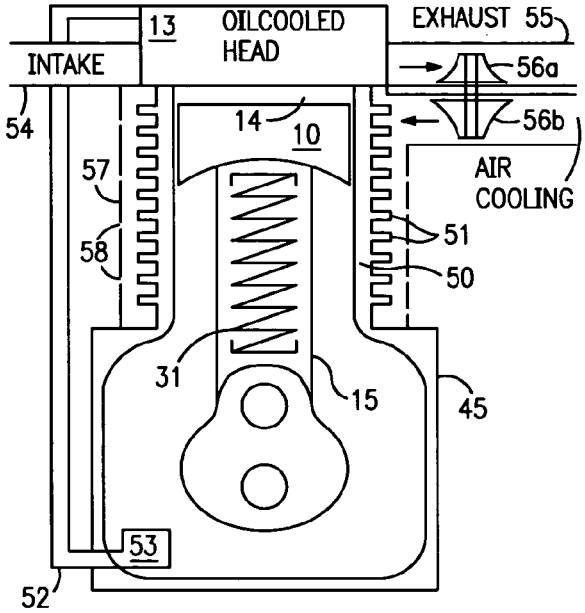
FIG. 11 is a partial side-view of a preferred embodiment of an engine using the advantages of the HCX cycle and system in the form of a minimally cooled air-cooled engine which can use any of the HCX flexible systems, especially of FIGS. 7, 9 and 10, with that of FIG. 8 shown, to provide a lightweight, simple, low-cost, high efficiency engine.

FIG. 11 is a partial side-view of a preferred embodiment of an engine using the advantages of the HCX cycle and system in the form of a minimally cooled air-cooled engine which can use any of the HCX flexible systems, especially of FIGS. 7, 9 and 10, to provide a lightweight, simple, low-cost, high efficiency engine. Like numerals represent like parts with respect to the earlier figures.

In this embodiment, the HCX feature is shown as a spring 31 inside the connecting rod 15, as in FIG. 8. The cylinder 50 is shown with cooling fins 51, and the cylinder head 13 is shown fed by oil from a tube 52 connected to the bottom of the crankcase 45 to a pump 53. The oil may provide secondary cooling of the cylinder head. Shown also is an intake 54 and exhaust 55 which preferably may include a turbine 56*a* connected to a cooling turbine 56*b* for providing air cooling, which is especially needed at higher engine speeds and loads where there is also excess exhaust pressure. The cooling air enters a shroud 57 and baffling surrounding the cylinder 50 and exits the shroud in properly placed air exhaust outlets 58 to evenly cool the cylinder.

Figure 12A:
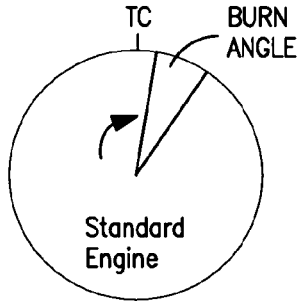
FIGS. 12*a* and 12*b* represent timing diagrams depicting ignition and combustion burn angles for a standard and the preferred HCX cycle engine.
Figure 12B:
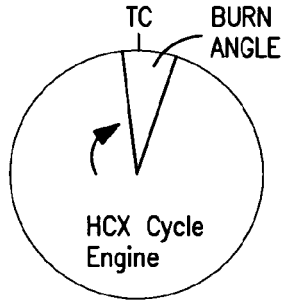

FIGS. 12*a* and 12*b* represent timing diagrams depicting ignition and combustion burn angles for a standard and the preferred HCX cycle engine. In the standard engine, FIG. 12*a*, the burn angle is after top center (TC) in order to insure that at high loads one does not have excessive pressure from occasional fast burn cycles as typically occur due to engine cycle-to-cycle variation. With the HCX cycle engine, the burn angle can be advanced for closer to TC peak pressure, with any occasional excessive pressure taken up by the HCX spring system.

Which brings us to a preferred embodiment based on the development of certain high strength titanium alloys, alloy Ti38644 and titanium LCB, which have been developed with essentially the same tensile strength of spring steel (chrome-vanadium steel), but which have 0.6 times the density of steel and have half the modulus of elasticity E of spring steel.

This now brings us to the design of special pistons in which disc springs are located inside the piston 10 to produce the HCX effect by special designs in which the springs are kept at a high pre-load pressure Ppre of approximately 400 psi to 600 psi, for typical engine applications. This requires unique designs of two-part pistons in which the piston can be assembled with the springs placed under compression at a pre-load pressure Ppre to be further and controllably compressed in operation in an engine running at high load.

Figure 13:
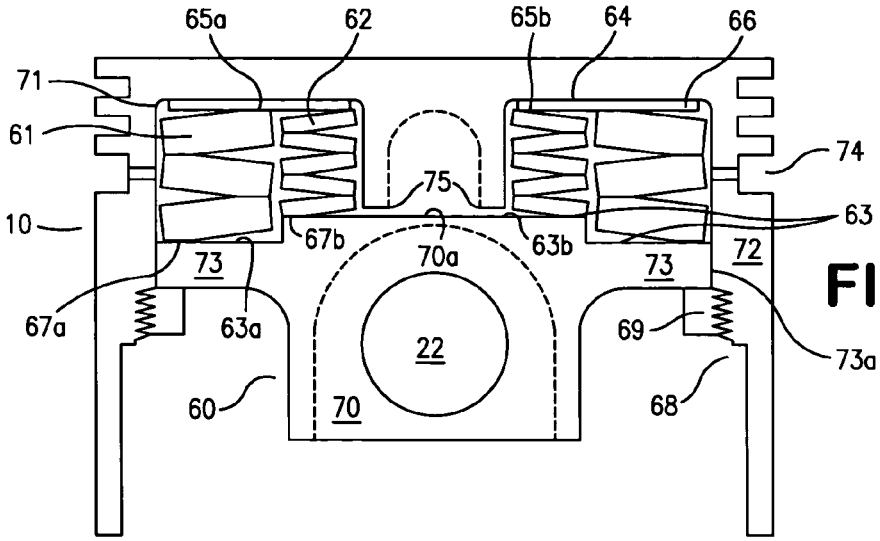
FIG. 13 is an approximately to-scale side-view drawing of a preferred embodiment of a piston which uses a "saddle" in which is located a wrist pin of the connecting rod, wherein the saddle holds one or more sets of disc springs (two sets shown) between the top of the saddle and the inside of the piston top to provide a preferred embodiment of the invention in terms of producing the HCX cycle effect.

FIG. 13 is an approximately to-scale side-view drawing of a preferred embodiment of a piston 10 which uses a "saddle" 60 in which is located a shortened wrist pin 22 of the connecting rod 11 (FIG. 7, 8), wherein the saddle holds one or more sets of disc springs (two sets shown, outer 61 and inner 62) between the top of the saddle 63 and the inside of the piston top 64 to provide a preferred embodiment of the invention in terms of producing the HCX cycle effect. In the figure is shown interposed between the inside piston top 64 and the top edges of the springs 65*a* and 65*b* a cylindrical thin washer 66 of low abrasion material to minimize wear between the top edges 65*a*, 65*b* and the washer (and also protect the inside top 64 of the piston). The top and bottom springs may need to have special coatings to protect their top edges 65*a* and 65*b* and bottom edges 67*a* and 67*b* from abrasion as they slide back and forth on being compressed (at high engine load conditions). Alternatively, especially for the smaller, lighter springs, 62, the top and bottom spring may be of spring steel which has good abrasion qualities, or any combination of these and other methods to provide sufficient life of the springs. A heat insulating barrier coating may also be placed on the inside top surface 64 of the piston to limit heating of the springs (especially of the top spring which may be of higher temperature material). Also, preferably, the edges of the spring will be flat as shown, i.e. have contact flats to distribute the forces and reduce wear.

In this design, the saddle 60 is shown attached to the inside edge of the piston 68 by means of a threaded ring 69. This method of supporting the saddle has the advantage that the ring can be adjusted by tightening to compress the springs to a precise pre-load pressure Ppre. On installation, the springs are compressed by pushing on the bottom of the saddle and the ring is turned until the desired pre-load pressure is attained. In this preferred embodiment, the top of the saddle 63 has two levels, a lower level 63*a* for the outer spring 61 and a higher level 63*b* for the inner spring 62 to accommodate the partial cavity 70 in which the top of the connecting rod can rotate (shown as a dashed curve). Note that the top of the cavity comes close to the top middle section of the saddle (70*a*), and may even break through to locate the wrist pin 22 as high as is practical. However, unlike a conventional wrist pin, which is held on two sides of the piston (see FIG. 7, 8), this shortened wrist pin is held entirely by the saddle, on two sides extending beyond the cavity 70 (not shown as it is in a view 90° rotated), and of length just under the inside diameter of the ring 69. In turn, the saddle is held by the piston by means of the treaded ring 69, as shown.

The springs can have their contact points to the piston and saddle be on the inside or outside of the spring edge, and depending whether an even or odd number are used, both can be at the same diameter point or not. In this case, the outer top spring has its contact point on the inside edge, and the bottom spring on the outside (given there are an odd number of springs). The same is shown for the inside springs (also odd number). This embodiment allows for forming a relatively large radius of the inside corner 71 of the piston for strength so that the piston wall thickness 72 can be minimized to accommodate a maximum diameter De of the outer spring relative to the piston diameter D.

The wing section 73, which can be a complete or partial cylinder, is the member that transfers the connecting rod/wrist pin assembly side force to the piston via the outer wing section surface 73*a* riding against the piston's inner surface which produces the unavoidable side forces on the piston. In this preferred embodiment, the contact surfaces 73*a* are approximately half way up the piston length. In operation, at high engine loads, the piston top pushes to compress the springs and the piston slides down by an amount up to xo relative to the saddle guided by the surface 73*a*, which is preferably lubricated with engine oil. The oil can flow into the spring section through the oil holes typically located in the oil ring groove 74, which also lubricate and cool the springs, and drain through holes on the saddle if it is a complete circular section, or otherwise if it is a partial circular section. Preferably, there is also one or more "stops", a central stop section 75 shown here forming a small gap with the piston top, whose outer diameter also acts as an inside guide for the small inside springs. The stop is designed such that the springs will not be compressed beyond a certain point, typically up to xo which not beyond 0.8 of the full dish height h. Note that in the piston of FIG. 14, the stops can be on the extension sections 73*b* of the wing section 73.

Figure 14:
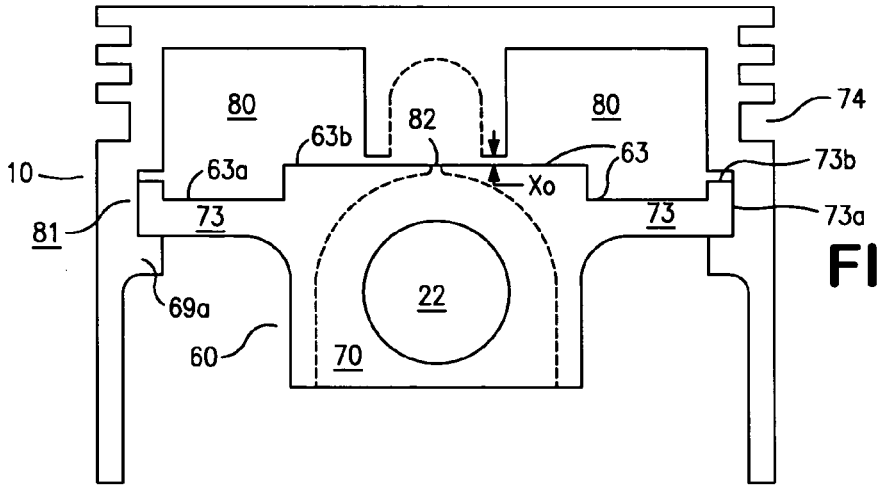
FIG. 14 is a variant of the piston of FIG. 13.

FIG. 14 is a variant of the piston of FIG. 13 without any springs shown in the somewhat different cavity 80, wherein the ends 73*a* and 73*b* of the wing section are keyed into a slot 81 cut into the inside section of the piston, where the section 69*a* replaces the ring section 69 of FIG. 13. In this case, the wing section 73 is a partial circular section which is keyed into the piston by compression and rotation, and then locked from rotating relative to the piston but being able to slide up and down (for the required motion defined by xo or slightly higher before being stopped). Like numerals represent like parts with respect to the parts in FIG. 13.

Figure 6B:
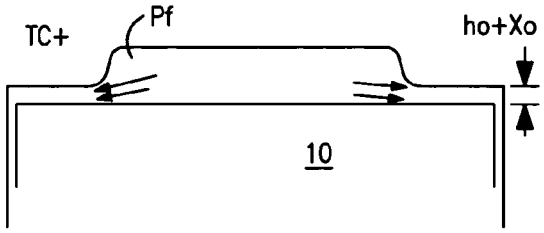

In this embodiment, if a ring section 69 is used instead of 69*a* such that the saddle wing section is an entire cylindrical section, then the cavity can be sealed (assuming no oil holes in the oil ring groove 74). This allows for other options for spring material in the cavity 80. One option is to have an elastomer material filling the entire cavity of suitable spring constant k. Another is to use a special lubricant with suitable compression characteristics, and by insuring little leakage past the wing ends 73*a* (which may contain a pressure ring, not shown), an HCX feature can be attained. The "elastic" lubricant can be force fed through the connecting rod and up through a hole 82 which is open when the connecting rod is at an angle from the vertical (piston is away from top center), and is sealed around top center, e.g. say at 45° plus or minus from top center. Note that the cavity 80 can be of a variety of shapes, and is shown as an example that would be consistent with that of FIG. 6.

Figure 15:
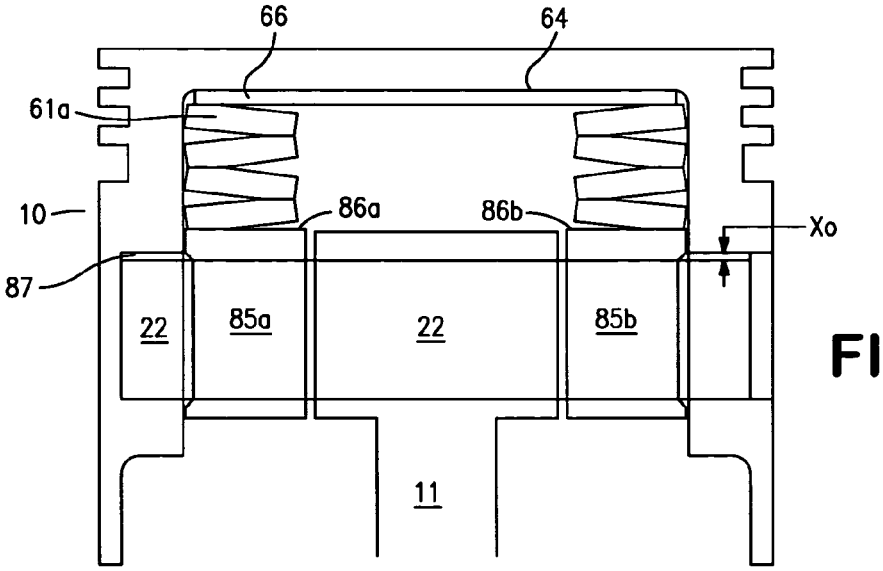
FIG. 15 is an approximately to-scale side-view drawing of a preferred embodiment of a piston which uses a vertically movable wrist pin on which are mounted two cylindrical tube sections with flat tops for supporting disc springs between their flat sections and the inside of the piston top.

FIG. 15 is an approximately to-scale side-view drawing of a preferred embodiment of a piston which uses a vertically movable wrist pin 22 on which are mounted two cylindrical tube sections 85*a* and 85*b* with flat tops 86*a* and 86*b* respectively for supporting disc springs 61*a* (four shown) between their flat top sections and the inside of the piston top (wherein a washer 66 is located). Like numerals represent like parts with respect to the parts in FIG. 13.

In this embodiment, the system resembles a more conventional piston in that the wrist pin 22 is located on the outer piston section in a groove which is a slightly elongated circular section 87 with clearance xo so that in operation at high engine loads, the outer piston section can slide vertically relative to the wrist pin by an amount xo. This design has the advantage that it may be somewhat lighter, but it has greater difficulty in accommodating more than one set of springs (four stacked springs shown), and the sliding section 87 being much smaller than that of FIGS. 13 and 14 may not be as robust as that of the saddle slide sections 73*a* of those figures.

Figure 16:
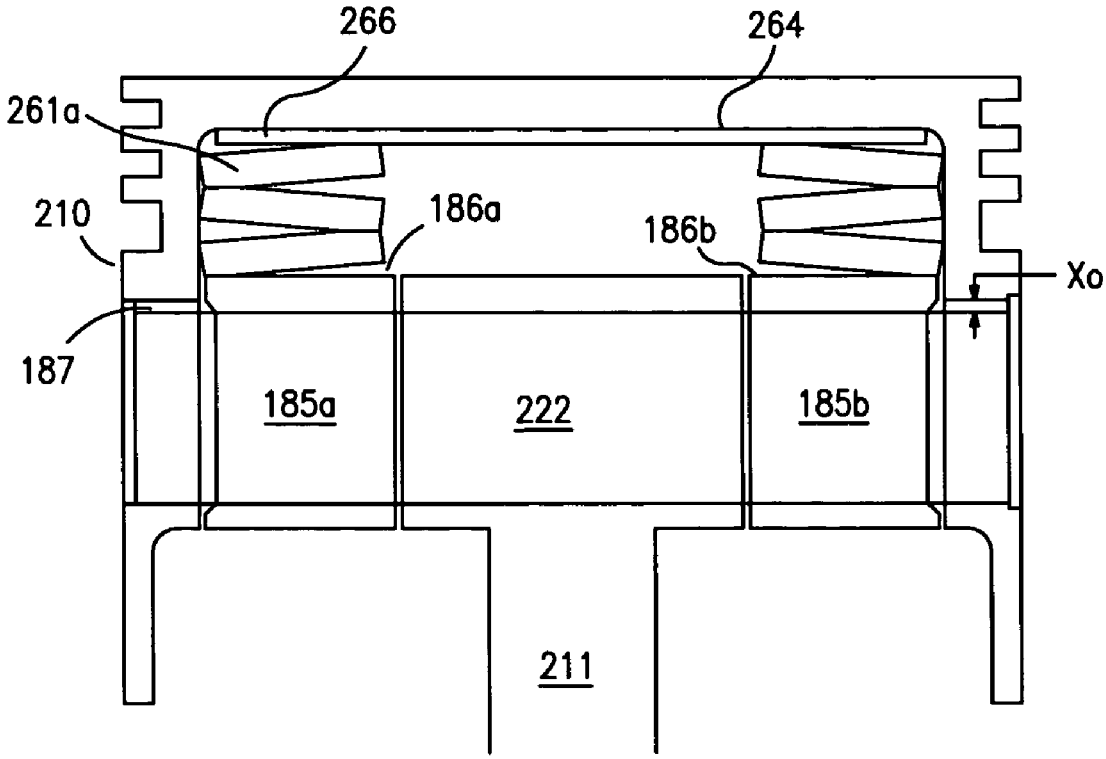
FIG. 16 is a piston having three spaced Titanium springs affording to the piston a compression ratio of 13.5 to 1 which becomes approximately 9 to 10 to 1 compression ratio at high pressure. Also, three spaced steel disc springs are added for comparison.

FIG. 16 shows is a piston with three disc springs 210 with three internal titanium springs constructed to provide a compression ratio of 13.5 to 1 (springs at pre-load of, say, 475 psi) at lights loads, which becomes approximately 10 to 1 compression ratio at high pressure (final spring load Pf=600 psi). The figure is an approximately to-scale side-view drawing of a preferred embodiment of a piston which uses a vertically movable wrist pin 222 on which are mounted two cylindrical tube sections 185*a* and 185*b* with flat tops 186*a* and 186*b* respectively for supporting equally spaced disc springs 261*a* (three shown) between their flat top sections and the inside of the piston top (wherein a washer 266 is located).

In this embodiment, the system resembles a more conventional piston in that the wrist pin 222 is located on the outer piston section in a groove which is a slightly elongated circular section 187 with clearance xo so that in operation at high engine loads, the outer piston section can slide vertically relative to the wrist pin by an amount xo. This design has the advantage that it may be somewhat lighter. A preferred design for FIG. 5 has typical dimensions for a typical cylinder in an typical multi-cylinder engine given below with three titanium springs per cylinder.

CR0=13.5 to 1 CR1=10 to 1 where CR0 is maximum CR (13.5 to 1 in this example) and CR1 is minimum CR (10 to 1).

BORE=3.5" STROKE=S=3.0"

$ho=S/(CR0-1)=0.24"$

Ppre=475 psi Pf=600 psi Pi=900 psi $xo=(2/3)*ho*(Pi/Pf-1)=0.080"$ $xi=[(Ppre)/(Pf-Ppre)]*xo=(475/125)*0.080"=0.30"$ $x1=xi+xo=0.38"$ $EReff=S/(ho+xo)+1=10$ to 1 is the *CR* at maximum load (lowest *CR* of 10 to 1).

Since three springs are used, and each is compressed by xi/3 (0.10"), then each is pre-compressed by 0.10". For the Titanium Ti38644, one has De equal to 76 mm, t=3.8, and ho=3.4 mm (length of spring 7.2 mm). The pre-compressed length equals to 7.2−2.5 per spring, or 4.7 mm, or 14 mm for three springs (0.55").

$t/D=[(\pi/4)*Pf/(\sigma*F1)]^{1/2}$ $\sigma=Y*[t/De]^2*[D/De]^2*s/t$ $s/t=(4/\pi)*\sigma^2*[De/D]^2*F1/(Y*Pf)$, $Y=(1/2)*1.5*(4*E)/(1-\mu*\mu)$ $\sigma=220{,}000$ psi $Y=(1/2)*197{,}000{,}000$ psi $t/D=1.89*(Pf/F1)^{1/2}*10^{-3}$ $s/t=628*(De/D)^2*F1/Pf$ $F1\approx1.15$ $De/Di\approx1.75$ Pf=600 psi D=3.5" De=3.0"

$t/D=0.043t=0.15"$ as predicted, or 3.8 mm.

$h/t=(1.2)*(De/D)^2h/t=0.88$ h=0.134" as predicted, or h=3.4 mm.

$s_{max}=75*h=0.10"$

Three springs equals 0.55, and fully compresses equal 0.47, and the analysis is consistent for Ti38644.

For the same engine with the same CR, we assume three steel springs instead of three Titanium and different value of Ppre and slightly different Pi of 881 psi.

Ppre=400 psi Pf=600 psi Pi=881 psi $xo=(2/3)*ho*(Pi/Pf-1)=0.075"$ $xi=[(Ppre)/(Pf-Ppre)]*xo=(400/200)*0.075"=0.15"$ $x1=xi+xo=0.225"$ Since three springs are used, and each is compressed by xi/3 (0.05"), then each is pre-compressed by 0.05". For spring steel, we have De equal to 76 mm, t=4.0, and h0=2.4 mm (length of spring 6.4 mm). The pre-compressed length equals to 6.4−1.2 per spring, or 5.2 mm, or 15.6 mm for three springs (0.615"). Then three springs have a total compressed length off 15.6 mm−0.075", or 0.615"−0.075", or 0.54", i.e. the total length at Pf of 600 psi is equal to 0.54", or 13.7 mm, or 12.0 mm and 1.7 mm dish, or s/h0=0.87. Before start of compression, s/h0=0.76.

The steel disc springs have a Ppre of approximately 400 psi (+) and Pf under 600 psi (−), so three steel disc springs will work well and have a weight of ½ pound per cylinder, versus ⅓ pound for Titanium. For a 76 mm and t=4 mm, for s/h0=0.75, the force equals 19,200 N, equals 4,300 pounds, which is close to 4,000 lbs (400 psi). At s/h0=1.0, the force equals 19,200+6,400. Note that 500 psi equals 5,000 lbs. For full compression, i.e. s/h0=0.75 to s/h0=1.0, psi goes from 430 to 575. Therefore, for this low compression ratio (13.5 to 1), the steel disc springs work well (as does the titanium).

Given the above disclosure, one can develop many more embodiments within the scope of the present invention which realize some or all of the benefits. The present invention enables a new regime of IC engine technology characterized by higher efficiency and higher power, with greater knock control at higher compression ratios.

There are many other possible configurations for the HCX cycle and the HCX cycle engine, with the ones disclosed herein representing some preferred embodiments of such possible configurations. These include the definition and design of the flexible, low loss means, for producing the HCX effect, in terms of designs based on pre-load and set forces, spring constants, expected spring elongation, both pre-load xi' and actual xo', from which a properly designed HCX system can be arrived at to provide high efficiency at light loads through high compression ratio and preferably lean burn, and higher power at WOT with controlled and limited pressures.

It should be noted that the HCX cycle can be implemented with a variable compression ratio (VCR) engine, wherein the HCX system would provide instantaneous response to pressure, as opposed to most known VCR systems which, by necessity, have some time-lag. In addition, in such an application, the pressure differences that need to be taken up by the spring systems would be less than without the VCR system, and the VCR system would need to provide a lesser range of variation in the compression ratio.

What is claimed is:

1. An internal combustion engine or like power delivery system comprising:

(a) a piston of substantially cylindrical form and a compression-combustion-expansion cylinder adapted to contain the piston's reciprocating movement, and means for transmitting piston movement, (b) a spring operatively coupled between the piston and means for transmitting, which may be the spring directly coupled to the piston when it is inside the piston, or when it is outside the piston the spring is indirectly coupled to the piston motion, (c) the spring being located inside or outside the piston, and when it is located inside the piston it is made up of disc or wave type compression springs of high spring constant of thousands of pounds per inch as required in the HCX system, and for a typical average engine of 3.5 inches bore diameter and 3.5 inch stroke S, and for the springs being located between the wrist pin and the inside of the piston top, the springs must have a pre-load force Fpre greater than 3,000 pounds force with a pressure Ppre over 300 psi, i.e. the spring must not flex under 3,000 pounds force and 300 psi, and Fpre is also greater than the centripetal force at bottom center Fcent at a high engine speed of approximately 5,000 RPM of a typical average engine with a mass weight M of 2 pounds for the piston and movable outer portion of the connecting rod, and wherein it is not possible to meet these conditions with coil springs but it is possible with disk springs, and when the spring is outside the piston and outside the cylinder wall such that the combustion cylinder and combustion chamber would be affected by the spring and it is able to use either a coil or disc spring since the length of the spring can be much longer than the piston length, (d) the diameter of the spring being equal to 0.7 to 0.9 of the piston diameter if the spring is inside the piston and the inner diameter of the spring being no less than ⅜ the diameter of the spring as is the case of conventional disc spring, or if it is outside of the piston it is an external spring which is outside the cylinder which contains the piston and is able to provide a force of thousands of pounds per inch, the cylinder and cylinder head being able to have small vertical upward movement relative to the piston and to the crankcase base plate when the pressure force in the combustion chamber exceeds the pre-load force Fpre, (e) the system being constructed and arranged so that at light engine load the compression ratio (CR) is equal to or greater than 13 to 1 designated as CR0 with no elongation or contraction of the spring from its pre-load position, at medium load has a compression ratio less then CR0 but greater than CReff, where CReff is effective compression ratio at an assembly operating condition of wide open throttle (WOT) when used in a combustion engine has a CR equal to CReff, the minimum CR, and (f) the CR being less than CR0 as would occur at medium or higher load which would lead to a flexing of the spring, and the cycle on the compression stroke (known as the HCX cycle) being one where the pressure goes between Ppre and less than or equal to Pf, where Ppre is pre-load pressure value and Pf is peak set pressure, (g) and Fpre is constrained to be greater than half the total compression of the springs, or more exactly between 0.56 of Ff and 0.94 of Ff, where Ff is the settle or set force which typically taken on the value of approximately 0.75*h0 to 1.0*h0, where h0 is the cone height of an unloaded single spring, (h) and wherein at light load the CR is maximum and the piston to head clearance is minimum and the air squish is higher which permits a much leaner and faster burn operation for greater engine efficiency, and at high load the CR is equal to CReff to give a maximum clearance and lower heat transfer to the walls.

2. The system of claim 1 wherein the springs inside the piston are two or more disc springs placed in stacks of "i" springs in single series and comprise springs made of alloys of more than 50% steel.

3. The system of claim 1 wherein the springs inside the piston are two or more disc springs placed in stacks of "i" springs in single series and comprise springs made of alloys of more than 60% titanium.

4. The system of claim 1 wherein the medium load causes the spring to deflect and the CR to drop to between CR0 and CReff, where CReff is between 8 to 1 and 11 to 1, and the combustion chamber are two valve chambers with squish flow occurring in the combustion chamber at ignition.

5. The system of claim 1 wherein CR0 is between 13 to 1 and 15 to 1.

6. The system of claim 1 wherein Ppre, the pre-load pressure, is between 350 psi and 500 psi, Pf is between 450 psi and 650 psi and Pi is about between 750 psi and 1,080 psi where Pi is the high peak pressure of the Otto cycle.

7. The system of claim 1 wherein Ppre, the pre-load pressure, is between 450 psi and 600 psi, and Pf is between 550 psi and 750 psi and Pi is about between 915 psi and 1,250 psi where Pi is the high peak pressure of the Otto cycle.

8. The system of claim 1 comprising a compression-combustion-expansion cylinder which is a free standing engine cylinder as could be found in an air-cooled engine with a coil spring able to provide force of thousands of pounds per inch under tension outside the cylinder to allow for small vertically upward movement of the cylinder and cylinder head relative to the piston and crankcase when the pressure force in the combustion chamber exceeds the pre-load force Fpre (and pre-load pressure Ppre).

9. The system of claim 1 with a spring outside the piston and cylinder as recited in claim 1 wherein the spring is located in the crank case outside of an elongated larger diameter extension of the engine cylinder and is under compression instead of tension to allow for the use of long, large diameter disk type spring means of high spring constant k of thousands of pounds per inch to allow for small vertically upward movement of the cylinder and cylinder head relative to the piston when the pressure force in the combustion chamber exceeds the pre-load pressure Ppre.

10. The system of claim 1 wherein the piston uses a "saddle" in which is located a wrist pin of the connecting rod, wherein the saddle holds one or more sets of disc springs between the top of the saddle and the inside of the piston top to provide a preferred embodiment in terms of producing the HCX cycle effect.

11. The system of claim 1 having a preferred embodiment of a piston which uses a vertically movable wrist pin on which are mounted two cylindrical tube sections with flat tops for supporting disc springs between their flat sections and the inside of the piston top.

12. The system of claim 1 wherein the piston having three spaced Titanium springs located inside the piston and affording to the piston a compression ratio of around 13.5 to 1 which becomes approximately 9 to 10 to 1 compression ratio at high pressure.

13. The system of claim 1 wherein the piston has an elongated skirt with a flexible material under tension contained between the wrist pin and the bottom end of the piston wherein the temperature is lower than above the wrist pin and more length is available for the flexible material to provide longer life, which allows small relative motion of the piston top relative to the wrist pin when the force on the piston face exceeds the pre-load force Fpre (and pre-load pressure Ppre) which the spring material is under.

14. The system of claim 1 wherein there is a preferred HCX system comprising a spring loaded engine connecting rod which is a means for transmitting piston movement and for storing the extra combustion energy at high load around TC, the connecting rod to be made to accommodate disk type stacked springs, which work only under compression, to provide the high spring constant k of thousands of pounds per inch.

15. An internal combustion engine or like power delivery system comprising:

(a) a piston of substantially cylindrical form and a compression-combustion-expansion cylinder adapted to contain the piston's reciprocating movement, and means for transmitting piston movement, (b) a spring operatively coupled between the piston and means for transmitting, (c) the spring being located inside or outside the piston, and when it is located inside the piston it is made up of disc or wave type compression springs of high spring constant of thousands of rounds per inch as required in the HCX system, and for a typical average engine of 3.5 inches bore diameter and stroke S, and for the springs being located between the wrist pin and the inside of the piston top, the springs must have a pre-load force Fpre greater than 3,000 pounds force with a pressure Ppre over 300 psi. i.e. the spring must not flex under 3.000 pounds force and 300 psi, and Fpre is also greater than the centripetal force at bottom center Fcent at a high engine speed of approximately 5,000 RPM of a typical average engine with a mass weight M of 2 pounds for the piston and movable outer portion of the connecting rod, and wherein the forces are proportionally lower by the area for a smaller bore diameter of the piston and proportionally larger by the area for a larger bore diameter of the piston, and wherein it is not possible to meet these conditions with coil springs but it is possible with disk springs which are used herein, and when the spring is outside the piston and outside the cylinder wall such that the combustion cylinder and combustion chamber would be affected by the spring and it is able to use either a coil or disc spring since the length of the spring can be much longer than the piston length, (d) the diameter of the spring if it is outside of the piston it is an external spring which is outside the cylinder which contains the piston and is able to provide a force of thousands of pounds per inch, the cylinder and cylinder head being able to have small vertical upward movement relative to the piston and to the crankcase base plate when the pressure force in the combustion chamber exceeds the pre-load force Fpre, (e) the system being constructed and arranged so that at light engine load the compression ratio (CR) is equal to or greater than 13 to 1 designated as CR0 with no elongation or contraction of the spring from its pre-load position, at medium load has a compression ratio less then CR0 but greater than CReff, where CReff is effective compression ratio at an assembly operating condition of wide open throttle (WOT) when used in a combustion engine has a CR equal to CReff, the minimum CR, and (f) the CR being less than CR0 as would occur at medium or higher load which would lead to a flexing of the spring, and the cycle on the compression stroke (known as the HCX cycle) being one where the pressure goes between Ppre and less than or equal to Pf, where Ppre is pre-load pressure value and Pf is peak set pressure, (g) and Fpre is constrained to be greater than half the total compression of the springs, or more exactly between 0.56 of Ff and 0.94 of Ff, where Ff is the settle or set force, (h) and wherein at light load the CR is maximum and the piston to head clearance is minimum and the air squish is higher which permits a much leaner and faster burn operation for greater engine efficiency, and at high load the CR is equal to CReff to give a maximum clearance and lower heat transfer to the walls.

16. The system of claim 15 having a preferred embodiment of a piston which uses a vertically movable wrist pin on which are mounted two cylindrical tube sections with flat tops for supporting disc springs between their flat sections and the inside of the piston top.

17. The system of claim 16 wherein one has one set of disc springs with between two and four disc springs.

18. The system of claim 16 wherein CR0 is approximately 14 to 1 and the pre-load Ppre is between 300 psi and 550 psi.

19. The system of claim 15 in which the piston uses, a "saddle" in which is located a wrist pin of the connecting rod, wherein the saddle holds one or two sets of disc springs between the top of the saddle and the inside of the piston top, to provide a preferred embodiment in terms of producing the HCX cycle effect, where a 2.5" to 4.5" diameter piston has disc springs of thickness 0.1" to 0.2", and the saddle is attached to the inside edge of the piston by means of a threaded ring, and whereby the method of supporting the saddle has the advantage that, on assembly, the ring can be adjusted by tightening to compress the springs to a precise pre-load pressure Ppre, the springs being compressed by pushing on the bottom of the saddle as the ring is turned until the desired pre-load pressure is attained.

20. The system of claim 19 wherein in operation the piston top pushes to compress the springs and the piston slides down by an amount up to xo relative to the saddle which is lubricated with engine oil, the oil flowing into the spring section through the oil holes typically located in the oil ring groove which also lubricate and cool the springs, and the oil drains through holes on the saddle if it is a complete circular section or otherwise if it is a partial circular section.

21. The system of claim 15 in which the piston uses a "saddle" in which is located a wrist pin of the connecting rod, wherein the saddle holds one or two sets of disc springs between the top of the saddle and the inside of the piston top, to provide a preferred embodiment in terms of producing the HCX cycle effect, where a 2.5" to 4.5" diameter piston of thickness 0.1" to 0.2".

22. The system of claim 15 in which the piston uses a "saddle" in which is located a wrist pin of the connecting rod, wherein the saddle holds one or two sets of disc springs between the top of the saddle and the inside of the piston top, to provide a preferred embodiment in terms of producing the HCX cycle effect, where the disc springs are of thickness 0.1" to 0.2", and the saddle is attached to the inside edge of the piston and said saddle contains a wing section which is keyed into a slot cut into the inside section of the piston, wherein the wing section is a partial circular section which, on assembly, is keyed into the piston by compression and rotation and then locked from rotating relative to the piston but being able to slide up and down for a required motion defined by an axial distance xo or slightly higher before being stopped.

23. The system of claim 15 wherein in between the inside piston top and the top edges of the springs is a cylindrical washer of low abrasion material to minimize wear between the top edges of the spring and the washer and also to protect the inside top of the piston, and wherein the washer is also a heat insulating barrier coating to limit heating of the springs, and wherein the edges of the spring will be flat, i.e. have contact flats, to distribute the forces, reduce wear, and decrease the localized heating of the spring.

* * * * *